US007131356B2

(12) United States Patent
Lin

(10) Patent No.: US 7,131,356 B2
(45) Date of Patent: Nov. 7, 2006

(54) HAND TOOL HAVING AN ADJUSTABLE HEAD WITH JOINT LOCK MECHANISM

(75) Inventor: Yu-Cheng Lin, Taichung (TW)

(73) Assignee: Lea Way Hand Tool Corporation (TW)

( * ) Notice: Subject to any disclaimer, the term of this patent is extended or adjusted under 35 U.S.C. 154(b) by 0 days.

(21) Appl. No.: 11/018,150

(22) Filed: Dec. 21, 2004

(65) Prior Publication Data

US 2005/0268753 A1 Dec. 8, 2005

(30) Foreign Application Priority Data

Jun. 2, 2004 (TW) ..... 93208736 U

(51) Int. Cl.
*B25B 13/58* (2006.01)
*B25B 23/16* (2006.01)

(52) U.S. Cl. ..... 81/180.1; 81/177.9

(58) Field of Classification Search ..... 81/180.1, 81/177.9, 177.8, 177.7, DIG. 5; 403/349
See application file for complete search history.

(56) References Cited

U.S. PATENT DOCUMENTS 943,757 A * 12/1909 Stephens ..... 81/177.9
1,144,907 A * 6/1915 Knipple ..... 81/177.9
1,615,169 A * 1/1927 Ellis ..... 81/177.8
2,705,897 A * 4/1955 Kentish ..... 81/177.9
4,333,366 A * 6/1982 Hurtig ..... 81/DIG. 5
6,295,898 B1 10/2001 Hsieh
6,405,620 B1 * 6/2002 Liao ..... 81/177.7
6,405,621 B1 * 6/2002 Krivec et al. ..... 81/177.9
2001/0000092 A1 4/2001 Jarvis

FOREIGN PATENT DOCUMENTS

| | | |
|---|---|---|
| EP | 0 377 777 | 7/1990 |
| GB | 273914 | 7/1927 |
| TW | 0088220940A01 | 10/2001 |

* cited by examiner

*Primary Examiner*—Hadi Shakeri
(74) *Attorney, Agent, or Firm*—Ladas & Parry LLP

(57) ABSTRACT

A hand tool having an adjustable head with a joint lock mechanism. The joint lock mechanism includes a first engaging device, a second engaging device, a pull button and a first elastic device. The pull button has a knob portion and an engaging portion beneath the knob portion and the engaging portion engages the second engaging device. The first elastic device is received in a first aperture and abuts against the second engaging device with a forward force such that the front end of the second engaging device is pushed to engage the first engaging device.

7 Claims, 7 Drawing Sheets

HAND TOOL HAVING AN ADJUSTABLE HEAD WITH JOINT LOCK MECHANISM

BACKGROUND OF THE INVENTION

1. Field of the Invention

The present invention relates to a hand tool having an adjustable head with joint lock mechanism, especially a hand tool with a head of adjustable angles and easier, more secure positioning. The present application claims priority based on ROC (Taiwan) Patent Application No. 093208736.

2. Description of the Related Art

Conventional hand tools with an adjustable head, for example, as disclosed in TW421111, corresponding to U.S. Pat. No. 6,295,898, and TW488349, comprise a head and a handle. The head has a convex portion which can be pivotally coupled to a concave portion of the handle. Teeth are disposed along the surface of the convex portion to engage a ball received in an aperture formed in an inner wall of the concave portion. A stop member is disposed between the head and the handle. A positioning portion is formed at a rear side of the stop member and is coupled to a front end of the handle. A toothed portion formed at a front side of the stop member is engageable with a toothed surface portion formed along the surface of one side of the convex portion. When the stop member is slid to a predetermined position, the adjustment and positioning of the head at a certain angle can be more securely and conveniently done. However, with this kind of wrench, the ball is of a circular shape and cannot ensure secure engagement, and similar to the configuration of a ball and a toothed portion of a convex portion, the toothed portion of the stop member and the toothed surface portion of the handle may be worn out after use for a long period, which can therefore cause inconvenience when in use and reduce the life time of the hand tool.

TW478444; has disclosed a wrench wherein a through hole is formed in the centre of a shaft and threads are formed on a wall of the through hole at a bottom of the shaft to receive an operation rod. A handle is mounted at a bottom end of the operation rod and rotates synchronously with the operation rod. A concave portion formed at a top end of the shaft is coupled to a head and secured by a screw. A retainer is received in the through hole of the shaft with its one end coupled to the top end of the operation rod and an arc shaped concave portion formed on the other end. A rotatable worm supported by a retainer is disposed in the concave portion of the shaft and a groove fitted with a clip is formed at a protrusion of the worm at one end. A worm gear is disposed at an extension end of the head and engages the worm. The other end of the worm is coupled to a pivotal block and a crane to actuate the worm gear and the worm such that the head can be rotated at any angle. Again, with this configuration, the worm and the worm gear may be worn out after use for a long period, which causes the local structure to be loose and unable to be positioned properly. In addition, it is likely that the clip, operation rod, the retainer or the pivotal block and the crane might become loose and make the wrench un-useable.

From the above, it is necessary for the industry to provide a hand tool having an adjustable head with joint lock mechanism, which offers convenient and secure angle adjustment and positioning and can overcome the defects mentioned in the prior art.

SUMMARY OF THE INVENTION

It is an object of the present invention to provide a hand tool having an adjustable head with joint lock mechanism, easier and more secure positioning.

According to the present invention, a hand tool having an adjustable head with joint lock mechanism comprises a head having a rear end and a handle having a front end pivotally coupled to the rear end of the head, characterized in that: the joint lock mechanism is disposed between the rear end of the head and the front end of the handle, and the joint lock mechanism further comprises a first engaging device, a second engaging device, a pull button and a first elastic device. The first engaging device is disposed at the rear end of the head. The handle has a first aperture longitudinally extending from the front end thereof to receive the second engaging device, and has a second aperture formed perpendicularly intersecting the first aperture to receive the pull button. The pull button has a knob portion and an engaging portion beneath the knob portion and the engaging portion extends along the second aperture and engages the second engaging device. The first elastic device is received in the first aperture and abuts against the second engaging device with a forward force such that the front end of the second engaging device is pushed to engage the first engaging device.

DESCRIPTION OF THE DRAWINGS

Other objects, advantages and novel features of the present invention will be drawn from the following detailed description of preferred embodiments of the present invention with the accompanying drawings, in which.

DETAILED DESCRIPTION OF THE INVENTION

Figure 1:
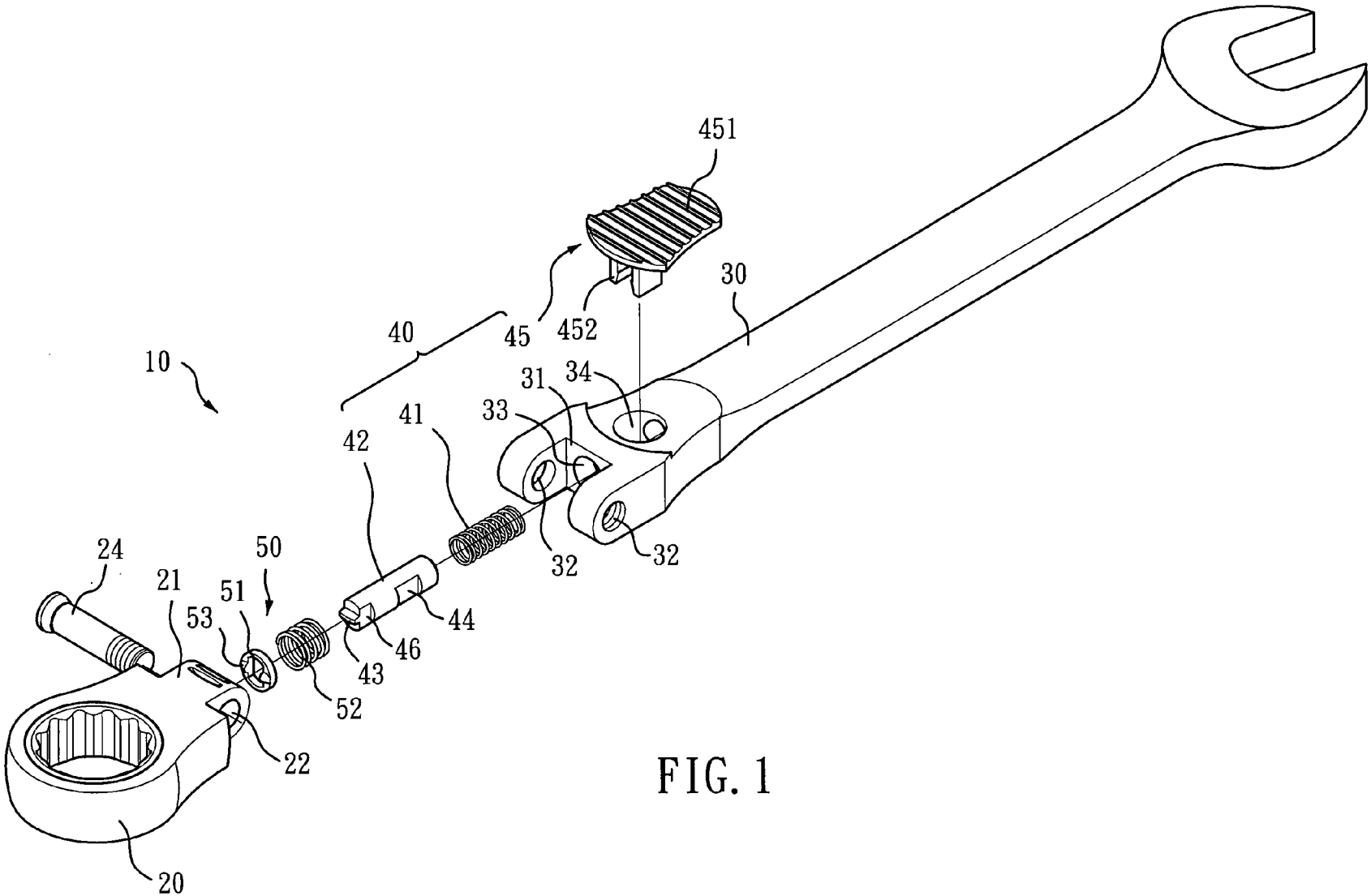
FIG. 1 illustrates an exploded view of a handle tool having an adjustable head with joint lock mechanism according to the present invention.

FIG. 1 illustrates an exploded view of a handle tool having an adjustable head with joint lock mechanism according to the present invention. A wrench 10 comprises a head 20, a handle 30 and a joint lock mechanism 40. A convex portion 21 is formed at a rear end of the head 20 and a through hole 22 is formed through the convex portion 21. A concave portion 31 is formed at a front end of the handle 30 and two through apertures 32 are formed at opposite sides thereof where one of the through apertures 32 is threaded to receive a screw 24 for pivotally coupling the head 20 to the handle 30. Regarding the configuration between the screw 24 and the two through holes 32, please refer to TW566274 for more details. A first aperture 33 is formed at the front end of the handle 30 and substantially extends along the length thereof, and a second aperture 34 is formed at one side of the handle 30 and perpendicularly intersects the first aperture 33.

Figure 1A:
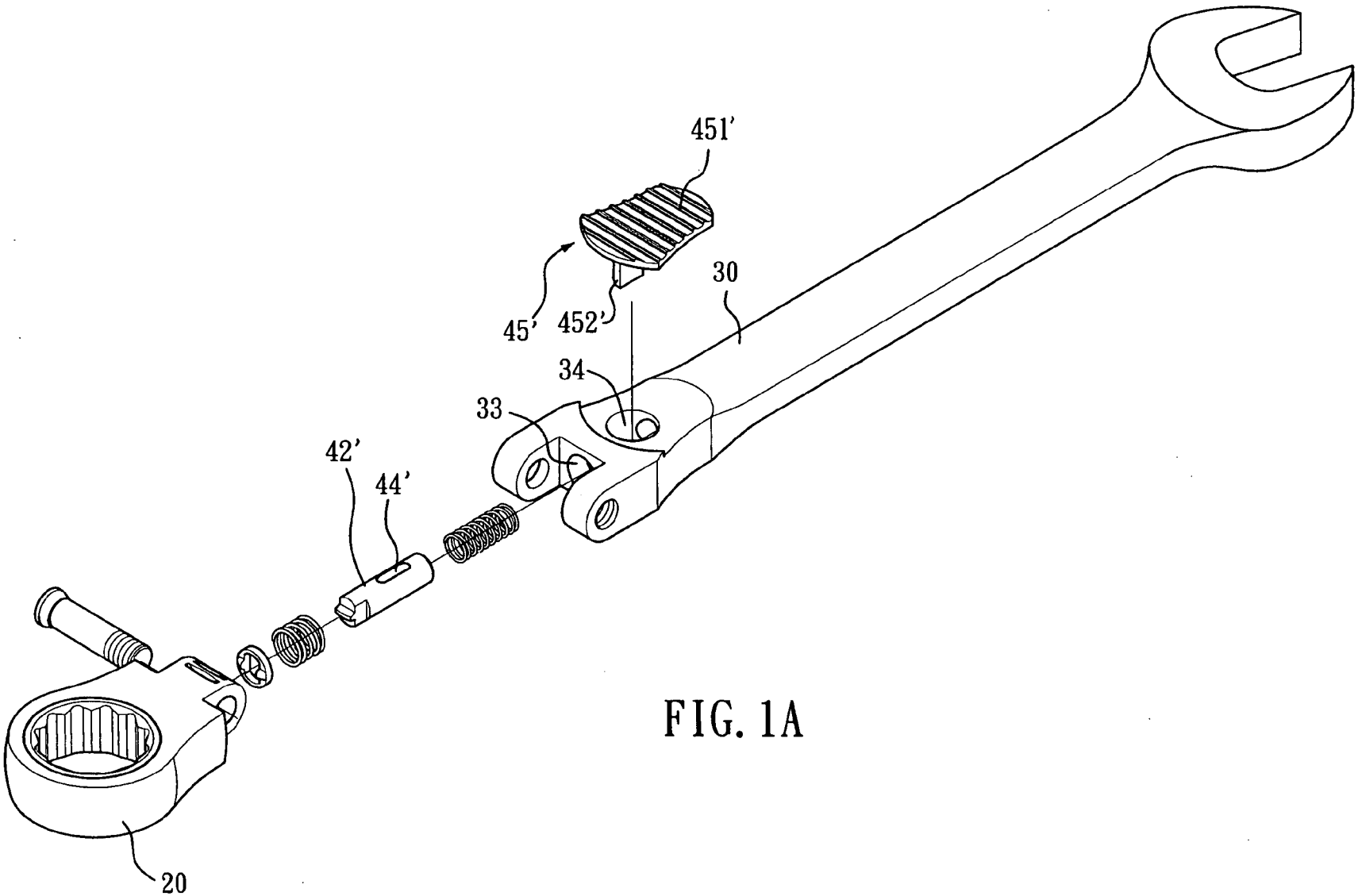
FIG. 1A is an exploded view similar to FIG. 1 showing a modified embodiment.
Figure 3:
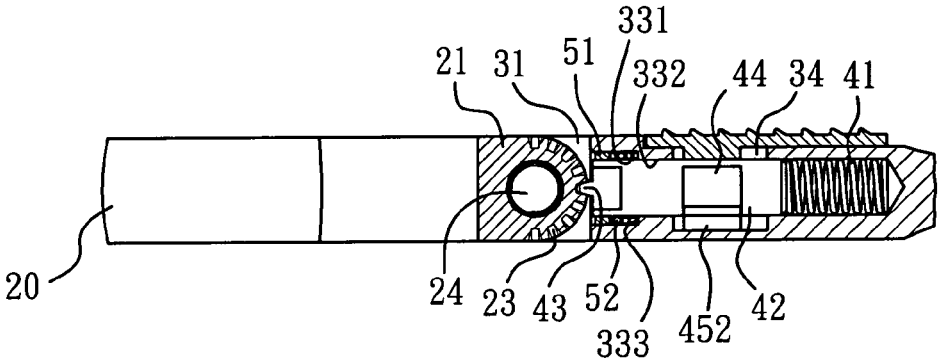
FIG. 3 illustrates a sectional view thereof along line A—A in FIG. 2 showing a pull button in a locked state.
Figure 4:
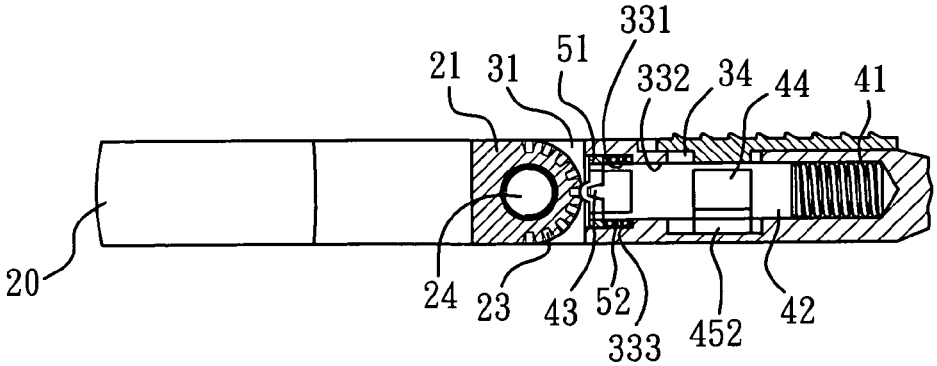
FIG. 4 illustrates a sectional view thereof along line A—A in FIG. 2 showing the pull button in an unlocked state.
Figure 12:
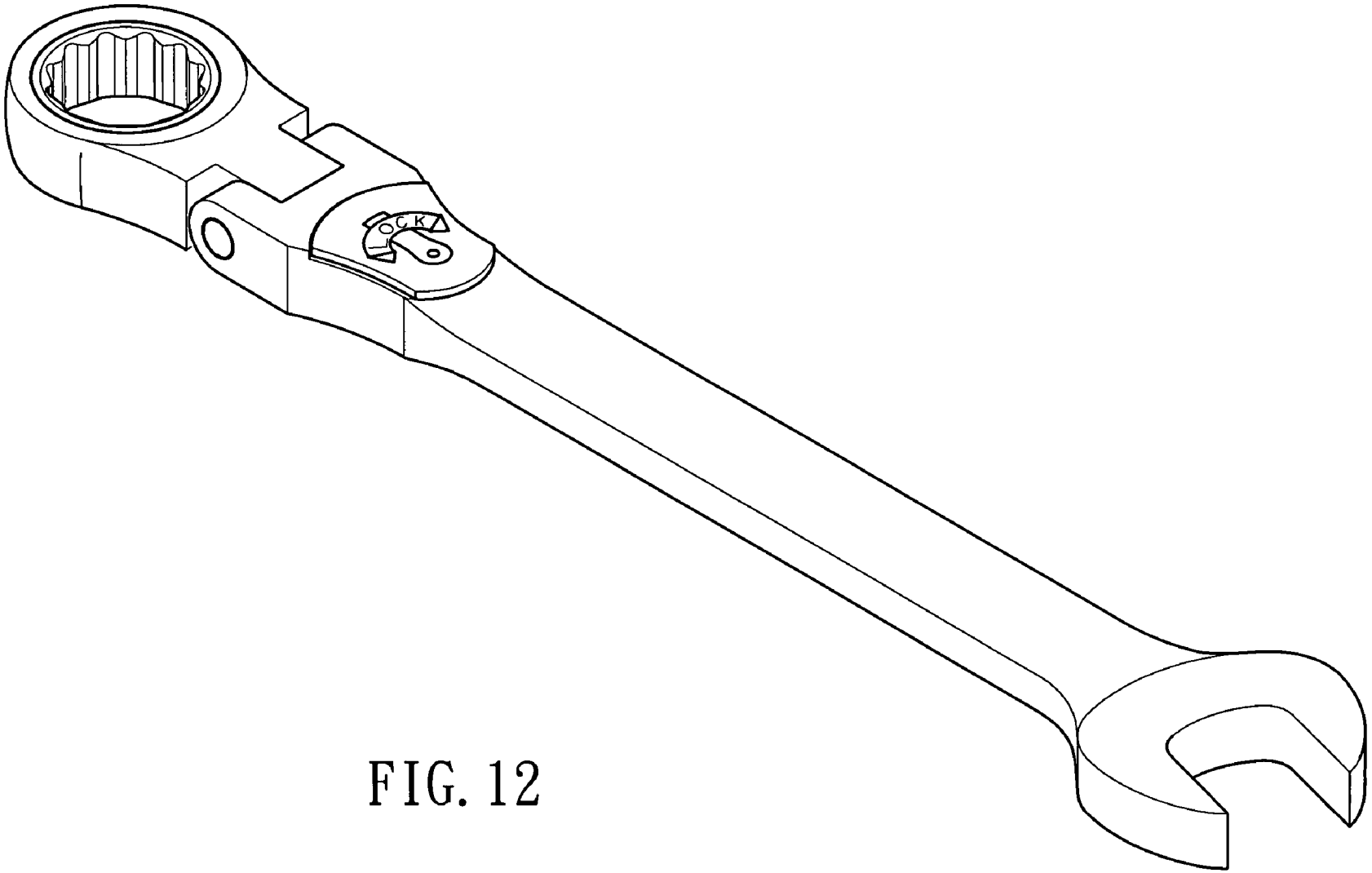
FIG. 12 illustrates a different pattern formed on the pull button.

A joint lock mechanism 40 comprises a first engaging device disposed at the rear end of the head 20, a second engaging device received in the first aperture 33 formed at the front end of the handle 30, a first elastic device and a pull button 45 comprising a knob portion 451 and an engaging portion. Preferably, the first engaging device can be a plurality of slots 23 formed equidistantly along the surface of the convex portion 21 and the slots 23 preferably extend along the axis of the through hole 22. In general, the surface of the convex portion 21 can be an arc of 180°, or of any other suitable shape. In this preferred embodiment, nine slots are formed so that the angle between two adjacent slots is 22.5°. Preferably, the second engaging device is a pin 42 and the first elastic device is a first spring 41. An engaging portion, which is a protrusion 43 of a substantially arc shape, is formed at a front end of the pin 42. As illustrated in FIG. 3, the first spring 41 is received at and abuts against a bottom end of the first aperture 33 and biases the pin 42 with a forward force such that the protrusion 43 of the pin 42 can be pushed to engage any of the slots 23. A pair of slots 44 is formed at the opposite sides of the pin 42 between the front and the rear ends of the pin 42. The engaging portion of the pull button 45 comprises two hooks 452 disposed beneath the knob portion 451 and extending along the second aperture 34 to engage the corresponding pair of slots 44 such that the pull button 45 can be pulled to actuate the pin 42 to move along the first aperture 33. The knob portion 451 can be of a shield design formed with a plurality of anti-slip teeth thereon or with a pattern consisting of a word "LOCK", a mark facing the side of the head and a double arrow crossing the mark (referring to FIG. 12). Alternatively, the pin 42' can be formed with a through slot 44' between the front and the rear ends thereof (see FIG. 1A) and the engaging portion of the pull button 45' can be a hook extending along the second aperture 34 to engage the through slot 44' such that the pull button 45 can be pulled to actuate the pin 42' to move along the first aperture 33.

Preferably, the joint lock mechanism 40 can further comprise a positioning device 50 having a positioning element, preferably a positioning plate 51, and a second elastic device, preferably a second spring 52. The positioning plate 51 is received in a front portion 331 of the first aperture 33 having a larger diameter (referring to FIG. 3), which can be formed by reaming a stepped aperture at the front end of the first aperture 33, while a rear portion 332 thereof has a smaller diameter (referring to FIG. 3). A pair of slots 46 is disposed at the front end of the pin 42 and the positioning plate 51 is received in the slots 46. The positioning plate 51 has a shape substantially matching that of the protrusion 43 so as to guide the protrusion 43 to engage one of the plurality of slots 23. The second spring 52 is positioned behind the positioning plate 51 with its front end abutting against the positioning plate 51 with a forward force and its rear end abutting against a shoulder portion 333 formed between the front portion 331 and the rear portion 332, such that protrusions 53 of the positioning plate 51 and the protrusion 43 of the pin 42 can together engage one of the plurality of slots 23.

Figure 2:
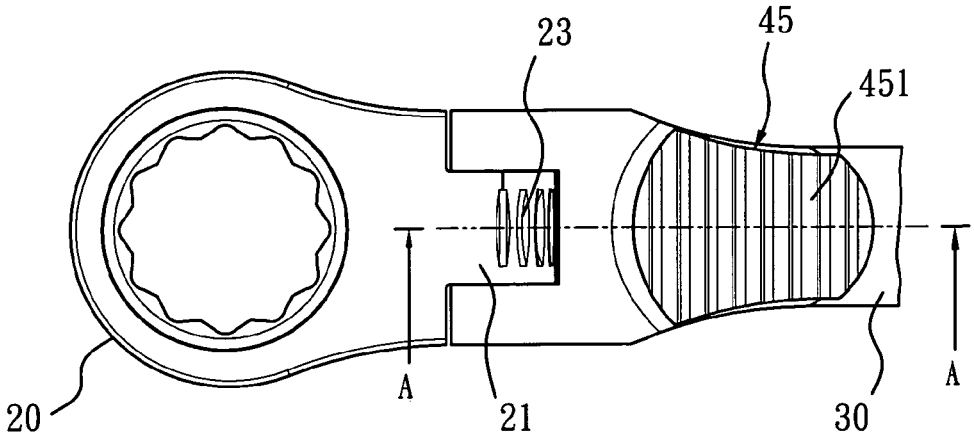
FIG. 2 illustrates a locally enlarged plan view thereof.
Figure 5:
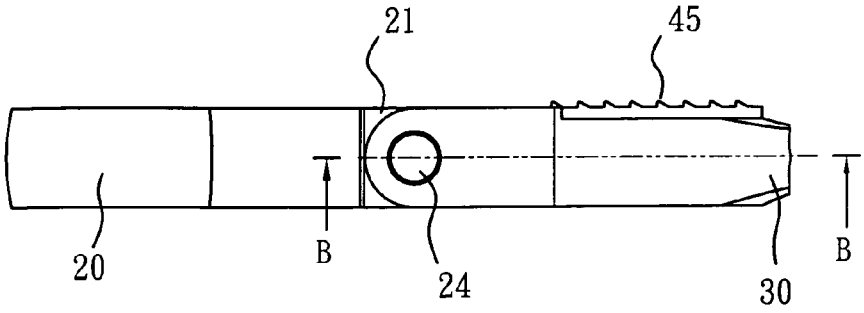
FIG. 5 illustrates a locally enlarged side view thereof.
Figure 6:
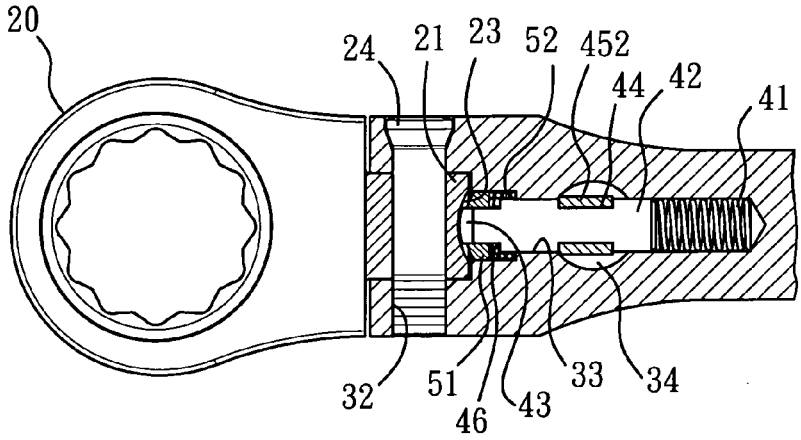
FIG. 6 illustrates a sectional view thereof along line B—B in FIG. 5 showing the pull button in a locked state.
Figure 7:
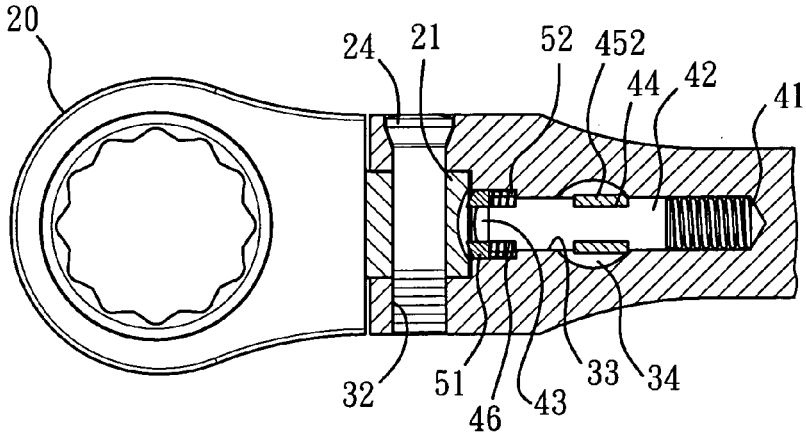
FIG. 7 illustrates a sectional view thereof along line B—B in FIG. 5 showing the pull button in an unlocked state.
Figure 8:
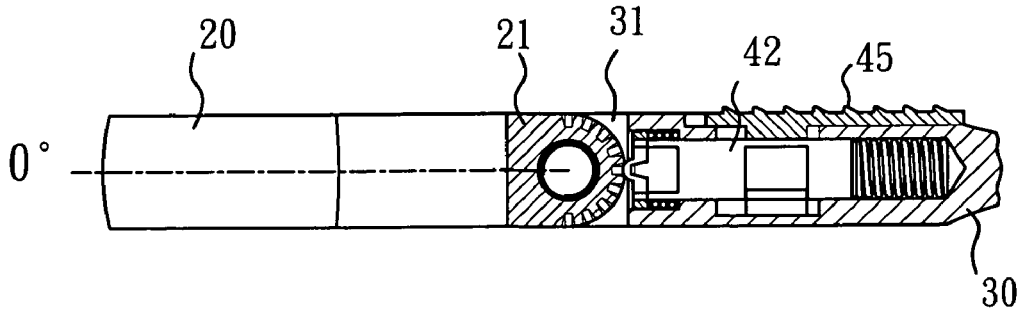
FIG. 8 illustrates a sectional view thereof along line A—A in FIG. 2 showing the head inclining 0° with respect to a handle.
Figure 9:
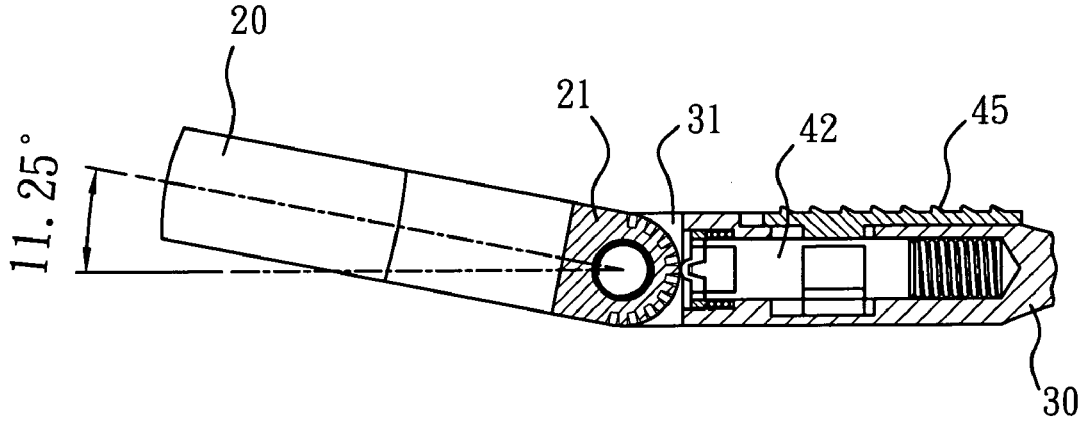
FIG. 9 illustrates a sectional view thereof along line A—A in FIG. 2 showing the head inclining 11.25° with respect to the handle.
Figure 10:
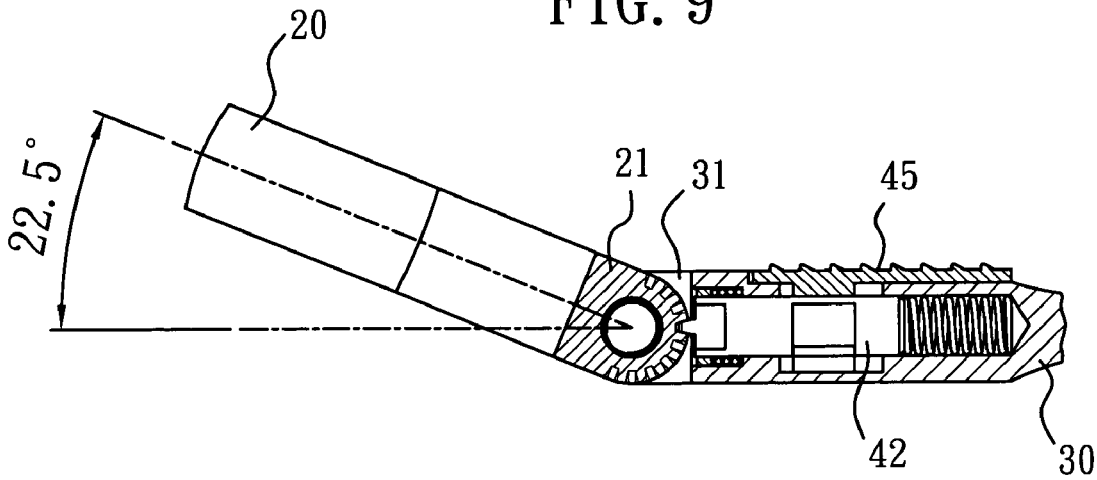
FIG. 10 illustrates a sectional view thereof along line A—A in FIG. 2 showing the head inclining 25° with respect to the handle.
Figure 11:
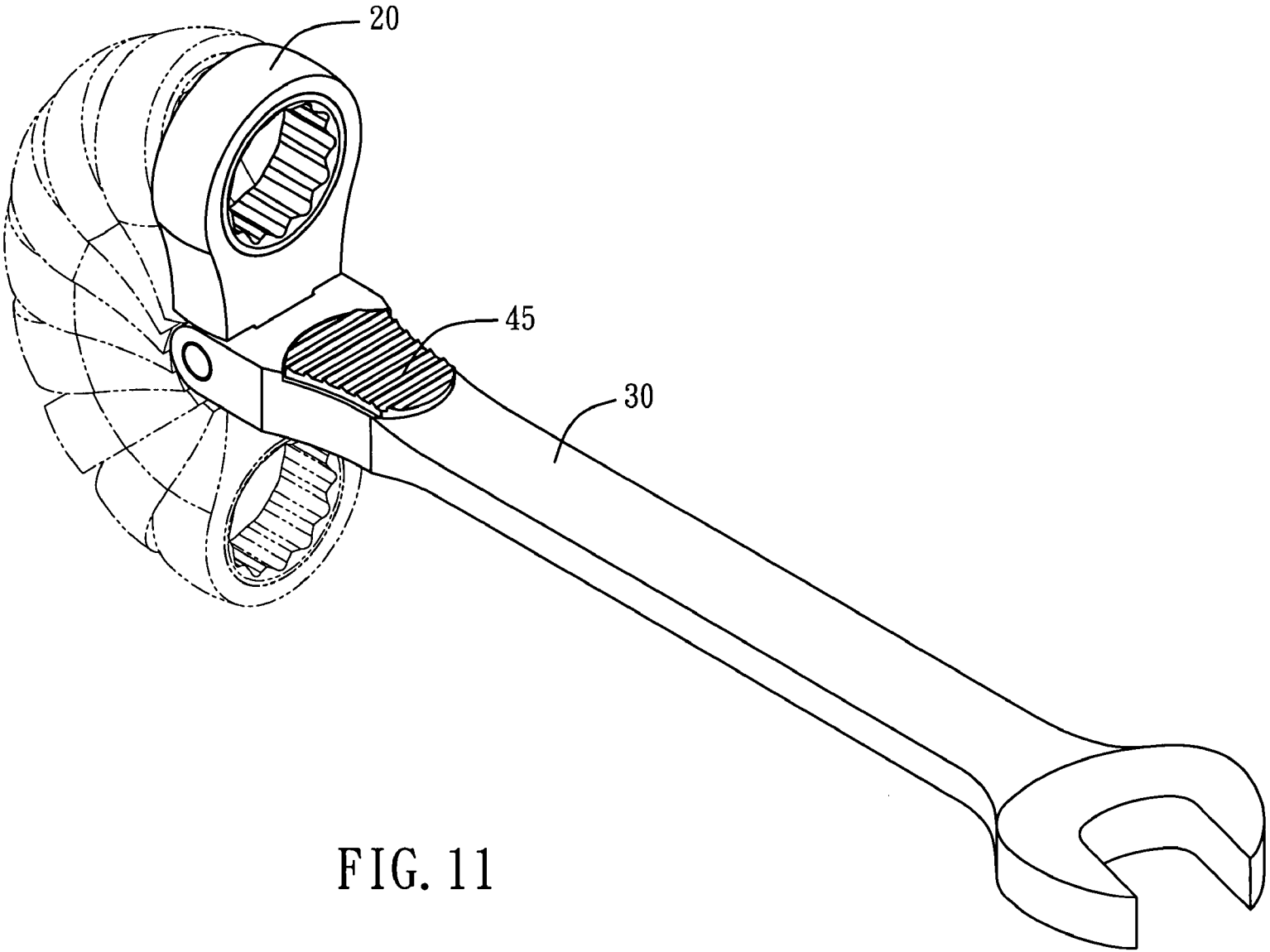
FIG. 11 illustrates the head rotating at multiple angles.

FIGS. 2 and 5 illustrate a locally enlarged plan view and a locally enlarged side view of the hand tool according to the present invention, respectively. From FIGS. 3 and 6, it can be seen that when the pull button 45 is in at a locked state, each of the protrusion 43 of the pin 42 and the protrusions 53 of the positioning plate 51 can moveably engage one of the plurality of slots 23, whereas only the protrusions 53 of the positioning plate 51 can moveably engage one of the plurality of slots 23 when the pull button 45 is in an unlocked state. Therefore, when the pin 42 disengages the head 20 in the unlock state, the head 20 can pivotally rotate with respect to the handle 30 and also be prevented from rotating due to gravity. As illustrated in FIGS. 8 to 10, when an external force drives the head 20 to a certain angle, the head 20 can be bent and positioned to a predetermined angle. FIG. 11 illustrates the head rotating at multiple angles.

From the above descriptions, it is apparent that the present invention provides a hand tool having an adjustable head with joint lock mechanism and has easier and more secure positioning compared to the prior art. While the invention has been described in terms of several preferred embodiments, those skilled in the art will recognize that the invention can still be practiced with modifications, within the spirit and scope of the appended claims.

What is claimed is:

1. A hand tool having an adjustable head with a joint lock mechanism, comprising:

a head having a rear end, the rear end having a convex pivotal portion;

a handle having a front end, the front end having a concave pivotal portion pivotally coupled to the convex pivotal portion of the rear end of the head, the handle having a first aperture longitudinally extending from the front end thereof, and a second aperture perpendicularly intersecting the first aperture;

a fastening device disposed through the convex pivotal portion and the concave pivotal portion such that the fastening device is pivotally coupled to the convex pivotal portion while being fixedly coupled to the concave pivotal portion; and the joint lock mechanism being disposed between the rear end of the head and the front end of the handle;

the joint lock mechanism comprising:

a first engaging device disposed at the rear end of the head, the first engaging device having a plurality of slots spaced equidistantly along the surface of the convex pivot portion;

a second engaging device received in the first aperture of the front end of the handle, the second engaging device having a front end and a rear end, and the second engaging device having at least one engaging portion formed at the front end thereof;

a pull button having a knob portion and an engaging portion beneath the knob portion, the engaging portion extending along the second aperture and engaging the second engaging device;

a first elastic device received in the first aperture and abutting against the second engaging device with a forward force such that the front end of the second engaging device is pushed to engage the first engaging device; and a positioning device having a positioning element and a second elastic device, the positioning element being disposed at the front end of the first aperture and having a shape substantially matching that of the engaging portion of the second engaging device so as to guide the engaging portion of the second engaging device to engage one of the plurality of slots; the second elastic device being positioned behind the positioning element and abutting against the positioning element with a forward force.

2. The hand tool according to claim 1, wherein the first aperture has a front portion having a larger diameter and a rear portion having a smaller diameter which forms a shoulder portion in between, and the second elastic device is disposed in the front portion with its front end abutting against the positioning device while its rear end abuts against the shoulder portion.

3. The hand tool according to claim 1, wherein the second engaging device includes a pair of slots formed at opposite sides between the front and the rear ends thereof, and the engaging portion of the pull button comprises two hooks engaging the corresponding pair of slots such that the pull button is adapted to actuate the second engaging device to move along the first aperture.

4. The hand tool according to claim 1, wherein the second engaging portion has a through slot formed between the front and the rear ends thereof, and the engaging portion of the pull button is a hook for engaging the through slot such that the pull button is adapted to actuate the second engaging device to move along the first aperture.

5. The hand tool according to claim 1, wherein the surface of the convex pivot portion is an arc.

6. The hand tool according to claim 1, wherein the knob portion has a surface formed with a plurality of anti-slip teeth.

7. The hand tool according to claim 1, wherein the knob portion has a surface formed with pattern consisting of a word "LOCK", a mark at the side of the head and a double arrow crossing said mark.

* * * * *